US005964257A

United States Patent [19]

Lin et al.

[11] Patent Number: 5,964,257

[45] Date of Patent: Oct. 12, 1999

[54] APPARATUS AND METHOD FOR CLEANING A LIQUID DISPENSING NOZZLE

[75] Inventors: Hsun-Peng Lin, Nan-Chuang Village; Fu-Tein Wung, Tao-Yuan; Chih-Hsiung Lee, Hsin-Chu, all of Taiwan

[73] Assignee: Taiwan Semiconductor Manufacturing Company, Ltd., Hsin-Chu, Taiwan

[21] Appl. No.: 08/941,714

[22] Filed: Sep. 30, 1997

[51] Int. Cl.[6] ..... B65B 1/04

[52] U.S. Cl. ..... 141/90; 141/4; 141/64; 141/89; 141/91; 141/95; 134/102.2; 134/170

[58] Field of Search ..... 141/89, 90, 91, 141/92, 64, 95, 4; 239/104, 106, 398, 696; 222/148; 134/102.2, 170

[56] References Cited

U.S. PATENT DOCUMENTS 4,025,363 5/1977 De Santis ..... 134/102
4,305,413 12/1981 Dougherty ..... 134/90
4,713,257 12/1987 Luttermoller ..... 239/696
5,066,336 11/1991 Hoffman et al. ..... 141/90
5,213,117 5/1993 Yamamoto ..... 134/58 R
5,447,171 9/1995 Shibano ..... 134/102.2

*Primary Examiner*—Henry J. Recla
*Assistant Examiner*—Timothy L. Maust
*Attorney, Agent, or Firm*—Tung & Associates

[57] ABSTRACT

The present invention provides an apparatus and a method for cleaning a liquid dispensing nozzle that is utilized in semiconductor process machines by providing a cleaning solvent reservoir tank capable of receiving a dispensing nozzle and then flowing a cleaning solvent through the nozzle under pressure, and then purging through the dispensing nozzle with a processing fluid to later be utilized such that any residual cleaning solvent is purged out of the dispensing nozzle to prevent the possible back-flow or syphoning of the cleaning solvent into a processing fluid supply and the dilution of such processing fluid. The present invention apparatus is further equipped with a cleaning solvent buffer tank for holding and feeding a cleaning solvent to the reservoir tank such that the pressure in the reservoir tank can be suitably controlled.

29 Claims, 2 Drawing Sheets

APPARATUS AND METHOD FOR CLEANING A LIQUID DISPENSING NOZZLE

FIELD OF THE INVENTION

The present invention generally relates to an apparatus and method for cleaning a liquid dispensing nozzle utilized in a semiconductor processing machine and more particularly, relates to an apparatus and method for cleaning a liquid dispensing nozzle utilized in a machine for dispensing a processing liquid for a semiconductor process by first cleaning the nozzle with a solvent and then purging the nozzle with the processing liquid.

BACKGROUND OF THE INVENTION

In the fabrication of semiconductor devices, various processing steps, i.e., as many as several hundred, are necessary to process a bare silicon wafer to a completed semiconductor chip. One of the processing steps which must be repeated many times to define features or circuits on the wafer surface throughout the total fabrication is photolithography. In photolithography, a photoresist material in the form of a liquid is first dispensed uniformly on the surface of a wafer and then dried. The photoresist material is then exposed by one of several imaging techniques to reproduce a pattern of circuits. After the pattern of circuits is exposed in the imaging process, i.e., possibly in a stepper machine, a developer liquid is dispensed on the photoresist layer to develop the image. These processes, i.e., the photoresist coating process, the exposure or imaging process and the developer coating process can be carried out in either an off-line method or an in-line method. In the off-line method, the photoresist liquid is coated uniformly on the surface of a wafer in a coating machine and then dried, the wafer is then transported by an operator to a separate machine for the next step imaging and developer coating process. In more recently developed equipment, an in-line method is frequently used in which the photoresist coating process, the exposure or imaging process by a stepper and the developer coating process are performed in the same process machine at different stations. The wafer is transferred automatically between the stations without the attendance of an operator. The in-line process is therefore more economical to perform and higher quality product can be produced with reduced contamination problems.

In either the in-line process or the off-line process for photolithography, the step of applying a developer coating on the surface of a wafer is carried out by a liquid dispensing nozzle. The nozzle is normally constructed of stainless steel which has a multiplicity of capillary openings provided on a dispensing surface of the nozzle. A liquid flow is fed into the nozzle head through an inlet opening and transported to the multiplicity of capillary openings through numerous passages. A typical liquid dispensing system for a developer liquid is shown in FIG. 1.

FIG. 1 shows a conventional developer liquid dispensing system 10 consisting of a dispensing nozzle head 12 which is mounted on a liquid dispense arm 16. The liquid dispense arm moves in a horizontal position, i.e., to the left for dispensing a developer liquid on the surface of a wafer 20 mounted on a wafer chuck (not shown) and a rotating shaft 22, or to the right to a nozzle bath 30 for cleaning. The conduits 18, 24 and 26 are used to convey to the nozzle head 12 the developer liquid, and to vent the nozzle head 12. The nozzle head 12 is shown in a perspective view in FIG. 2 showing the multiplicity of capillary openings 14.

In a conventional method for operating the liquid dispensing nozzle head 12, during each dispense cycle the dispensing arm 16 moves to the left and then lowers itself onto the surface of wafer 20. To avoid the generation of air bubbles in the developer liquid dispensed, the liquid dispensing nozzle head 12 is positioned very close to the surface of the wafer 20. For instance, a distance of approximately 1.5 mm is normally maintained so that the developer liquid can be dispensed on the wafer surface without a long travel distance. At such a close proximity from the wafer surface, it is inevitable that some developer liquid sticks to the nozzle face 36 (shown in FIG. 2). During each liquid dispensing action the dispensing arm moves to the left and dispenses a developer liquid on the wafer supported by a wafer chuck rotated by shaft 22 at a predetermined speed. The dispensing arm 16 then moves to the right and to a position over a nozzle path 30 and lowers itself into the bath. After dipping the nozzle head 12 into the bath 30 which contains a suitable cleaning solvent for a predetermined amount of time, an inert gas is used to blow the channel openings in the nozzle head through the capillary openings 14 in an attempt to clean out the fluid passages.

The conventional cleaning method and the apparatus used for cleaning are not adequate for a thorough cleaning of the nozzle head 12. One reason for this inadequacy is that, due to the close proximity between the nozzle face 36 and the wafer surface, the developer liquid stuck on the nozzle face 36 crystalizes into solid particles after a few dispensing operations have been conducted. The crystalized developer material on the nozzle face 36 thus becomes a potential source of particle contamination on the wafer surface. The particle contamination by the crystalized developer material causes serious quality problems for any IC devices fabricated on the wafer.

It is therefore an object of the present invention to provide an apparatus for cleaning a liquid dispensing nozzle utilized in a semiconductor processing machine that does not have the drawbacks and shortcomings of the conventional apparatus used for cleaning such nozzles.

It is another object of the present invention to provide an apparatus that can be used effectively in cleaning a liquid dispensing nozzle used in a semiconductor processing machine that is equipped with a pressurized liquid bath into which a liquid dispensing nozzle can be immersed.

It is a further object of the present invention to provide an apparatus for cleaning a liquid dispensing nozzle used in a semiconductor processing machine that is equipped with a cleaning solvent buffer tank capable of feeding a cleaning solvent under pressure to a cleaning solvent reservoir tank into which a dispensing nozzle may be immersed.

It is another further object of the present invention to provide an apparatus for cleaning a liquid dispensing nozzle used in a semiconductor processing machine that is equipped with a cleaning solvent reservoir tank which has a level sensor and a drain passage for controlling the level of the cleaning solvent in the tank.

It is still another object of the present invention to provide a method for effectively cleaning a liquid dispensing nozzle utilized in a semiconductor processing machine that can be carried out by first rinsing the dispensing nozzle in a cleaning solvent and then purging the nozzle with a processing fluid to be dispensed.

It is yet another object of the present invention to provide a method for cleaning a liquid dispensing nozzle utilized in a semiconductor processing machine that is carried out by first pressurizing a cleaning solvent reservoir tank such that cleaning solvent enters capillary openings in the nozzle to throughly clean all fluid passages.

It is still another further object of the present invention to provide a method for cleaning a liquid dispensing nozzle utilized in a semiconductor processing machine in which the nozzle is blown out after a cleaning process such that no residual cleaning solvent may be syphoned back into a processing liquid reservoir and diluting the processing liquid.

SUMMARY OF THE INVENTION

In accordance with the present invention, an apparatus and a method for cleaning a liquid dispensing nozzle utilized in a semiconductor processing machine are provided in which a cleaning solvent buffer tank is used to feed a cleaning solvent to a reservoir tank which can be pressurized with an inert gas such that cleaning solvent enters all fluid passages in the nozzle head for a thorough cleaning operation.

In a preferred embodiment, an apparatus for cleaning a liquid dispensing nozzle is provided which includes a solvent buffer tank for holding and feeding a cleaning solvent, a solvent reservoir tank for receiving a cleaning solvent from the buffer tank, an inert gas supply for pressurizing the cleaning solvent in the reservoir, and a processing fluid supply for purging through the liquid dispensing nozzle. The liquid dispensing nozzle is equipped with a multiplicity of capillary openings as fluid passages for the processing liquid. The apparatus is further equipped with means for pressurizing the solvent buffer tank to facilitate the feeding of a cleaning solvent to the reservoir tank. The solvent reservoir tank may further include a level sensor and a drain passage wherein the level sensor controls the fluid level of the cleaning solvent in the tank and the drain package exhausts used cleaning solvent from the tank. The apparatus may further include a valve means installed between the solvent buffer tank and the solvent reservoir tank for controlling the flow of cleaning solvent to the reservoir tank.

The present invention is further directed to a method for cleaning a liquid dispensing nozzle that can be carried out by the operating steps of first providing a cleaning solvent reservoir tank, positioning a liquid dispensing nozzle in the reservoir tank and filling the reservoir tank with a cleaning solvent, then pressurizing the solvent such that it enters a multiplicity of capillary openings in the nozzle, exhausting the cleaning solvent from the nozzle and the reservoir tank, and then flowing a processing fluid through the liquid dispensing nozzle. The step of pressurizing the solvent such that solvent may enter a multiplicity of capillary openings can be accomplished by flowing an inert gas into the reservoir tank. A suitable inert gas used for such purpose is nitrogen.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus and a method for cleaning a liquid dispensing head used in a semiconductor processing machine that can be used to effectively clean a liquid dispensing nozzle head by first cleaning the nozzle openings with a cleaning solvent and then purging through the openings with a processing fluid.

Figure 1:
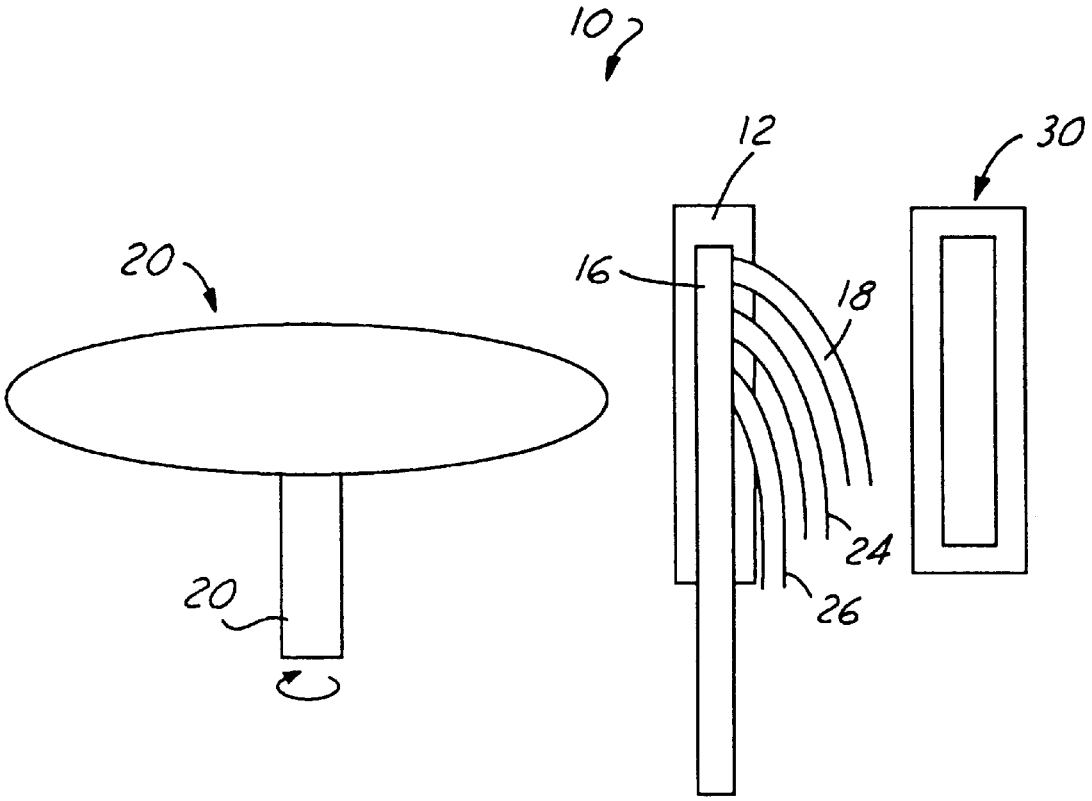
(PRIOR ART) FIG. 1
FIG. 1 is an illustration of a conventional set-up for a developer liquid dispensing system and a cleaning bath for the dispensing nozzle.
Figure 2:
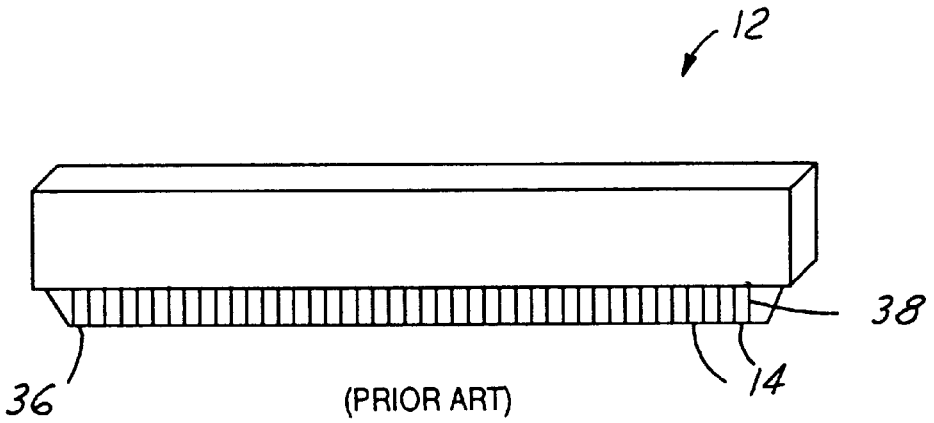
(PRIOR ART) FIG. 2
FIG. 2 is a perspective view of a liquid dispensing head having a multiplicity of capillary openings.
Figure 3:
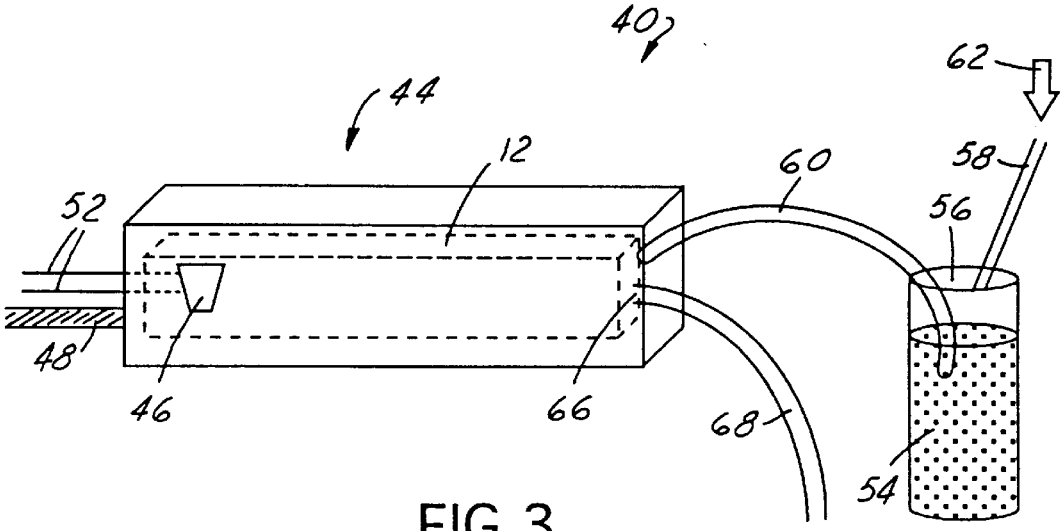
FIG. 3 is a perspective view of the present invention apparatus incorporating a cleaning solvent buffer tank, a reservoir tank, a level sensor and a drain passage.

Referring now to FIG. 3 wherein a present invention apparatus 40 is shown. The apparatus 40 consists mainly of a solvent buffer tank 42, a solvent reservoir tank 44, a level sensor 46 and a drain passage 48. The level sensor 46 has signal outputs 52 for sending signals indicating the fluid level in the reservoir tank 44 to a process controller (not shown). The solvent buffer tank 42 is used for storing a supply of cleaning solvent 54 which may be selected from a variety of suitable solvents. A few of such suitable solvents are deionized water (DI water), isopropyl alcohol (IPA) and acetone. It was found that while DI water is not the most effective cleaning solvent, DI water does not produce contaminating particles as easily as other hydrocarbon solvents. When DI water is used as the cleaning solvent, a more frequent cleaning interval can be used to make up for its lower cleaning efficiency. IPA and acetone, while being more efficient as a cleaner for developer liquid, tend to form contaminating particles more readily and thus causing contaminating problems. The contamination problems can be substantially reduced or eliminated by the practice of the present invention novel method and the utilization of the present invention novel apparatus.

The solvent buffer tank 42 is normally enclosed with an upper lid 56 and a conduit 58 is utilized to pump an inert gas from gas supply 62 into the tank 42. The inert gas facilitates the transporting of cleaning solvent 54 into the solvent reservoir tank 44 through conduit 60. A valve means (not shown) is normally provided somewhere between the reservoir tank 44 and the solvent buffer tank 42 and is in fluid communication with conduit 60 such that the conveyance of cleaning solvent 54 can be started or stopped by a process controller (not shown).

The control of the valve means for filling the solvent reservoir 44 is determined by signal outputs 52 sent out from the level controller 46. When the fluid level in the reservoir tank 44 is low, the sensor signal received by the process controller opens the valve means so that cleaning solvent flows into the reservoir tank 44. When fluid sensor signal received from the level sensor 46 is high, the process controller shuts off the valve means and thereby stops the flow of cleaning solvent 54 from entering the reservoir tank 44.

The reservoir tank 44 is charged with an inert gas which enters the tank at port 66 through a conduit 68. An inert gas, typically of nitrogen, used to charge the reservoir tank 44 may also be flown into the nozzle 12 through channel opening (not shown) such that cleaning solvent enters the multiplicity of capillary openings. The present invention apparatus 40 therefore enables an efficient cleaning process in which a cleaning solvent 54 is first forced into a liquid dispensing nozzle 12 and out of a multiplicity of capillary openings. The nozzle 12 is then purged with a processing liquid to be later utilized such that any residual cleaning solvent is purged out to eliminate any possibility of a back flow or syphoning of the solvent into the processing liquid reservoir.

Figure 4:
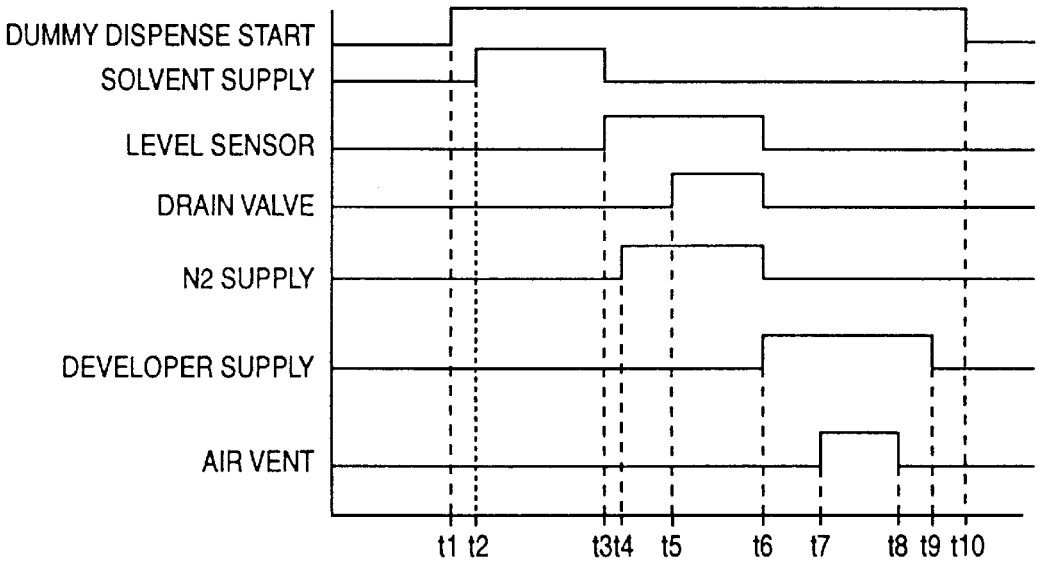
FIG. 4 is a timing sequence chart for the present invention method for cleaning a liquid dispensing nozzle head.

The operation of the present invention novel apparatus 40 can now be described as shown in FIG. 4 in a timing sequence chart. A typical developer liquid coating apparatus manufactured by TEL of Japan wherein a liquid dispensing nozzle a so-called $E^2$ nozzle is used for this illustration. At time t1, a so-called dummy dispense cycle is started which ends at t10. The dummy dispense cycle triggers a cleaning sequence when a liquid dispensing nozzle returns to a nozzle cleaning bath and lowers into the bath. Shortly after the start of the dummy dispense cycle at tl, the solvent supply 54 to the reservoir tank 44 is started at time t2. The solvent supply cycle ends at time t3 when the level sensor senses a high level of liquid in the reservoir tank 44. Immediately after the reservoir tank 44 is filled up with the cleaning solvent at time t3, an inert gas is pumped into the reservoir tank at time t4 to pressurize the solvent in the reservoir tank. This enables the solvent to enter all the capillary openings in the liquid dispensing nozzle 12. While the inert gas flow is continuing, at time t5, the drain passage (or drain valve) 48 opens to start an exhaust process for the cleaning solvent, i.e., most likely a DI water.

It should be noted that there is a delay time existing between t3 and t5 which allows an efficient cleaning process by the solvent when it enters the capillary openings in the dispense nozzle 12. The delay time of t5–t3 can be suitably adjusted and is dependent upon the degree of difficulty for the cleaning solvent to enter the capillary openings to carry out an efficient cleaning. The drain passage opens at time t5 and closes at time t6 when the level sensor senses a low liquid level in the reservoir tank 44. The inert gas supply to the reservoir tank 44 is shut off at time t6 when all the cleaning solvent has been exhausted out of the reservoir tank through the drain passage. It should be noted that the flowing of nitrogen gas into the reservoir tank 44 (or into the nozzle 12) is important for achieving the desirable benefits of the present invention method by allowing pressurized solvent to enter small fluid passages in the nozzle.

In the next step of the cleaning process, after the level sensor detects a low liquid level, the drain passage closes and the inert gas flow is shut-off at time t6. Simultaneously, the developer liquid is purged through the dispensing nozzle 12 until time t9 such that any residual cleaning solvent is purged out of the nozzle openings. This prevents any possible syphoning back of the cleaning solvent during a later developer dispensing process. When such syphoning occurs, the cleaning solvent dilutes the developer supply such that the amount of the developer liquid applied on a wafer surface may be reduced to such an extent that an image cannot be adequately developed. The processing liquid purging process is therefore another important aspect of the present invention method for achieving an efficient cleaning of a liquid dispensing nozzle.

During the purging process by the developer liquid (or any other processing liquid used in the semiconductor processing industry), an air vent (not shown) for the reservoir tank 44 is opened to allow any trapped air or bubbles in the developer liquid to exhaust out of the system. The air vent opens at time T7 and closes at time T8 before the end of the developer liquid purging process, i.e., time T9. At a later time t10, the dummy dispense cycle is completed to finish the solvent cleaning process for the liquid dispensing nozzle 12. A processing fluid dispensing operation can then start in a new cycle.

It should be noted that, while in the preferred embodiment illustrated above, a developer liquid dispensing system is used as an illustration, the present invention apparatus and method can be applied to any liquid dispensing operations for any other liquid processing fluids. The major benefits achieved by the present invention apparatus and method are made possible by the fact that a pressurized cleaning solvent system is used to force a cleaning solvent to enter small liquid passages (i.e., capillary openings) that are normally utilized in a liquid dispensing nozzle. Furthermore, the present invention novel method and apparatus are made possible by the use of a solvent buffer tank for holding and feeding a cleaning solvent to a cleaning tank. This further aids in the efficient cleaning of a liquid dispensing nozzle head. A special process control circuit is designed for the present invention apparatus such that the timing sequence chart (shown in FIG. 4) can be successfully carried out. The advantages achievable by the present invention novel apparatus and method have therefore been amply demonstrated by the above descriptions and the appended drawings.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

I claim:

1. An apparatus for cleaning a liquid dispensing nozzle comprising:

a solvent buffer tank for holding and feeding a cleaning solvent, a solvent reservoir tank for receiving and holding a cleaning solvent from said buffer tank, an inert gas supply for pressurizing said cleaning solvent in said reservoir tank, and a processing fluid for purging through said liquid dispensing nozzle.

2. An apparatus according to claim 1, wherein said liquid dispensing nozzle is equipped with a multiplicity of capillary openings as fluid passages for said processing fluid.

3. An apparatus according to claim 1 further comprising means for pressurizing said solvent buffer tank to facilitate the feeding of said cleaning solvent to said reservoir tank.

4. An apparatus according to claim 3, wherein said means for pressurizing said solvent buffer tank comprises a compressed air supply.

5. An apparatus according to claim 1, wherein said inert gas supply for pressurizing said cleaning solvent is selected from the group consisting of $N_2$, Ar and He.

6. An apparatus according to claim 1, wherein said inert gas supply for pressurizing said cleaning solvent is $N_2$.

7. An apparatus according to claim 1, wherein said solvent reservoir further comprises a level sensor and a drain passage.

8. An apparatus according to claim 7, wherein said level sensor controls a fluid level of the cleaning solvent in the reservoir tank and said drain passage exhausts used cleaning solvent.

9. An apparatus according to claim 1 further comprising valve means positioned between said solvent buffer tank and said solvent reservoir tank for controlling the flow of cleaning solvent to said reservoir tank.

10. An apparatus according to claim 1 further comprising a control circuit for controlling the timing sequence of a solvent cleaning and a processing fluid purging step.

11. A method for cleaning a liquid dispensing nozzle comprising the steps of:

providing a cleaning solvent reservoir tank, positioning a liquid dispensing nozzle in said reservoir tank, filling said reservoir tank with a cleaning solvent and pressurizing said solvent such that solvent enters a multiplicity of capillary openings in said nozzle, exhausting said cleaning solvent from said nozzle and said reservoir, and flowing a processing fluid through said nozzle.

12. A method according to claim 11 further comprising the step of filing said reservoir with a cleaning solvent from a buffer tank.

13. A method according to claim 12, wherein said buffer tank is pressurized to facilitate transporting said cleaning solvent to said reservoir tank.

14. A method according to claim 11, wherein said reservoir is further equipped with a level sensor for sensing the level of the cleaning solvent in said reservoir tank and for sending out a signal to a process controller.

15. A method according to claim 11, wherein said reservoir is further equipped with a drain passage for exhausting the cleaning solvent after the nozzle is cleaned.

16. A method according to claim 11, wherein said step of pressurizing said solvent such that said solvent enters a multiplicity of capillary openings in said nozzle is accomplished by flowing an inert gas into said reservoir tank.

17. A method according to claim 16, wherein said inert gas flown into said reservoir tank is $N_2$.

18. A method according to claim 11, wherein said step of flowing a processing fluid through said dispensing nozzle substantially purges out all residual cleaning solvent.

19. A method according to claim 11 further comprising the step of opening or closing a valve in fluid communication between said buffer tank and said reservoir tank.

20. A method according to claim 11 further comprising the step of exhausting said cleaning solvent from said reservoir tank and said dispensing nozzle after a delay time.

21. An apparatus for cleaning a liquid dispensing nozzle comprising:

a solvent buffer tank for holding and feeding a cleaning solvent, a solvent reservoir tank for receiving a cleaning solvent from said buffer tank, said solvent reservoir tank further comprises a level sensor and a drain passage, an inert gas supply for pressurizing said cleaning solvent in said reservoir tank, and a processing fluid for purging through said liquid dispensing nozzle.

22. An apparatus according to claim 21, wherein said liquid dispensing nozzle is equipped with a multiplicity of capillary openings as fluid passages for said processing fluid.

23. An apparatus according to claim 21 further comprising means for pressurizing said solvent buffer tank to facilitate the feeding of said cleaning solvent to said reservoir tank.

24. An apparatus according to claim 23, wherein said means for pressurizing said solvent buffer tank comprises a compressed air supply.

25. An apparatus according to claim 21, wherein said inert gas supply for pressurizing said cleaning solvent is selected from the group consisting of $N_2$, Ar and He.

26. An apparatus according to claim 21, wherein said inert gas supply for pressurizing said cleaning solvent is $N_2$.

27. An apparatus according to claim 21, wherein said level sensor controls a fluid level of the cleaning solvent in the reservoir tank and said drain passage exhausts used cleaning solvent.

28. An apparatus according to claim 21 further comprising valve means positioned between said solvent buffer tank and said solvent reservoir tank for controlling the flow of cleaning solvent to said reservoir tank.

29. An apparatus according to claim 21 further comprising a control circuit for controlling the timing sequence of a solvent cleaning and a processing fluid purging step.

* * * * *